United States Patent [19]

Fend et al.

[11] Patent Number: 4,817,308

[45] Date of Patent: Apr. 4, 1989

[54] STEAM PRESSING STATION FOR PRESSING FABRIC SEAMS

[75] Inventors: Fritz M. Fend, Regensburg; Dieter May, Walleshausen, both of Fed. Rep. of Germany

[73] Assignee: Veit GmbH & Co., Landesberg, Fed. Rep. of Germany

[21] Appl. No.: 98,492

[22] Filed: Sep. 18, 1987

[30] Foreign Application Priority Data

Sep. 26, 1986 [DE] Fed. Rep. of Germany ..... 3632839
Jul. 2, 1987 [DE] Fed. Rep. of Germany ... 8709122[U]

[51] Int. Cl.[4] ..... D06F 71/30
[52] U.S. Cl. ..... 38/1 B; 38/10; 38/14
[58] Field of Search ..... 38/10, 14, 1 B, 8, 9

[56] References Cited

U.S. PATENT DOCUMENTS 3,107,447 10/1963 Tucci ..... 38/10

FOREIGN PATENT DOCUMENTS 2528348 1/1976 Fed. Rep. of Germany ..... 38/1 B
3519814 12/1986 Fed. Rep. of Germany ..... 38/1 B

*Primary Examiner*—Andrew M. Falik
*Attorney, Agent, or Firm*—Kenyon & Kenyon

[57] ABSTRACT

In a steam pressing station, a fabric piece to be pressed is drawn into a gap between a lower pressing member and an upper pressing member by a conveyor belt movably attached to the lower pressing member. A clamping device is fastened to the conveyor belt for clamping a leading edge of the fabric piece to the belt during an intake stroke thereof. A fabric seam threading device is mounted to the upper pressing member for automatically separating fabric edge strips during the intake stroke of the conveyor belt. The fabric seam threading device includes a separator sword flanked on opposite sides by a pair of seam guides movably mounted for rapid adjustment of the vertical position of the seam guides relative to a frame of the fabric seam threading device and simultaneous rapid adjustment of the separation between the two seams guides.

14 Claims, 3 Drawing Sheets

1
2
3
4
5
6
7
7a
7b
8
9
9a
10
11
12
13
14
15
16
17
18
19
20
21
22
22a
22b
23
24
25
26
27
28
29
29a
30

STEAM PRESSING STATION FOR PRESSING FABRIC SEAMS

BACKGROUND OF THE INVENTION

This invention relates to a seam pressing station using steam for pressing fabric seams.

As disclosed in U.S. Pat. No. 3,107,447, a steam pressing station for reducing the time required for pressing seams during garment manufacture comprises a support stand, a lower pressing member or sleeper provided with a suction chamber, and a conveyor belt disposed with respect to the lower pressing member so that an upper section of the conveyor belt forms an upper pressing surface of the lower pressing member. An upper pressing member or sleeper is fastened to the support stand above the lower pressing member, a form pressing body being mounted to the upper pressing member for motion in a vertical direction substantially perpendicular to the pressing surface of the lower pressing member. The form pressing body is provided with a steam chamber connectable to a steam generator and with a pressing plate forming a lower wall of the steam chamber. The pressing plate is formed with a plurality of steam vents, while a fabric seam threading or fabric spreading device is mounted to a free end of the upper pressing member. In addition, a fabric receiving member or sleeper is attached to the forward or free end of the lower pressing member, extending the lower pressing member beyond the location of the fabric seam threading device.

In practice, difficulties have arisen in attempting to achieve neat and faultless pressing of seams by automatic processes. These difficulties arise in particular from the fact that the properties and nature of the fabric pieces to be pressed differ vastly over a wide range. Because of such variable fabric characteristics as stiffness and thickness of material, the feeding of fabric pieces into the gap between a lower pressing member and an upper pressing member is accomplished with varying effectiveness.

British Pat. No. 143,657 discloses a steam pressing station of the above-described type, in which the fabric piece to be pressed is drawn into the area between the lower pressing member and the upper pressing member by a clamp, rather than by a conveyor belt. The clamp is fastened to one of the pressing members so that it is longitudinally slidable therealong and holds the fabric piece by its edges.

Aside from the facts that such a drawing device permits only a relatively long operating cycle and that a pressed fabric piece must be drawn by hand from the steam pressing station, such an assembly does not ensure a faultless drawing in of the fabric pieces between the pressing members because the fabric, after being drawn onto the lower pressing member, very easily slides to one side or the other and prevents a neat seam press.

An object of the present invention to provide an improved steam pressing station of the above-described type.

Another object of the present invention is to provide such a steam pressing station in which the drawing in of a fabric piece between a lower pressing member and an upper pressing member, as well as the ejection of the fabric piece subsequent to a pressing operation, is accomplished faultlessly irrespective of the thickness and stiffness of the fabric material.

SUMMARY OF THE INVENTION

A steam pressing station for pressing fabric seams comprises, in accordance with the present invention, a support stand, a blower and a lower pressing member fastened to the support stand, the lower pressing member being formed with a suction chamber connected to the blower. The lower pressing member includes a conveyor belt forming a pressing surface on the top side of the lower pressing member. A motor device is operatively connected to the conveyor belt for selectively revolving same in either of the two opposite directions. The steam pressing station further comprises an upper pressing member fastened to the stand above the lower pressing member, the upper pressing member including a form pressing body movable in a direction substantially perpendicular with respect to the pressing surface of the lower pressing member. The form pressing body is provided with a heatable steam chamber connectable to a steam generator and with a pressing plate defining a lower side of the steam chamber and having a plurality of steam openings. A fabric seam threading device or fabric edge strip separating device is attached to the upper pressing member at a free end thereof for separating fabric edge strips extending from a seam to be pressed. The steam pressing station according to the present invention also comprises a fabric receiving member fastened to the lower pressing member at a free end thereof and a fabric edge holding device for clamping against the conveyor belt a leading edge of a fabric piece to be pressed upon a drawing of the leading edge past the fabric seam threading device and for continuing to hold the leading edge to the conveyor belt during a drawing of the fabric piece between the lower pressing member and the upper pressing member and past the fabric seam threading device. The fabric edge holding device is movably mounted to the stand to follow motions of the conveyor belt at the pressing surface.

The instant invention is founded on the realization that through the combination of a conveyor belt, on which a fabric piece is drawn in and out through the gap between the pressing members, and a fabric edge holding device, which holds the leading edge of a fabric piece drawn past the fabric seam threading device and which follows the motion of the conveyor belt, the effect on fabric piece guidance of different frictional adhesions between different fabric materials and the pressing surface of the lower pressing member, as well as different degrees of frictional drag exerted on different fabric materials by the fabric seam threading device, can be eliminated. In addition, the clamping of a leading edge of a fabric piece to the conveyor belt during a drawing in stroke thereof permits a significantly shortened weak cycle.

A steam pressing station further comprises, in accordance with another feature of the present invention, a lifting device operatively connected to the form pressing body for holding the form pressing body so that the pressing plate is disposed at a first distance from the pressing surface during a drawing in of the fabric piece and for holding the form pressing body so that the pressing plate is disposed at a second distance from the pressing surface during an ejection motion of the conveyor belt upon completion of a seam pressing process, the first distance being smaller than the second distance. The different distances between the form pressing body and the pressing surface during the intake and ejection strokes of the conveyor belt serve to maximize the speeds at which the respective operations can be implemented. In addition, the special requirements of curved seams can be served.

In accordance with another feature of the present invention, the fabric seam threading device includes a guide body mounted to the upper pressing member via a reciprocatable drive device, the fabric seam threading device further including a block-shaped seam folder adjustably mounted to the guide body for varying a vertical position of the seam folder relative to the guide body. A seam separator element attached to the seam folder is flanked on opposite sides by a pair of skid-shaped fabric seam guides also attached to the seam folder, the seam separator element having a tip projecting beyond free ends of the seam guides. Pursuant to a particular feature of the present invention, the seam guides are slidably attached to the seam folder so that a distance between the seam guides varies as a function of a vertical position of the seam guides relative to the guide part.

The guide part advantageously includes a head plate and a foot plate, the head plate being firmly connected to a reciprocatable element of the drive device and fastened to the foot plate via a plurality of bushings extending parallel to one another. The seam folder is slidably mounted to the guide part via a vertical extending guide pin, the fabric seam threading device further including a compression spring disposed between the foot plate and the seam folder for biasing the seam folder away from the guide part. The fabric seam threading device also includes a manually operable eccentric and a lift head element fastened to the guide pin at an upper end thereof in engagement with the eccentric for enabling a controlled lifting of the seam folder relative to the guide part and in opposition to a biasing force exerted by the compression spring.

The seam guides are advantageously fastened via respective connecting pieces to respective bearing plates each provided at a lower end with a bore traversed by a pin connected to the seam folder and formed at an upper end with a beveled end surface engaging a respective inclined face on the foot plate. The bearing plates are connected to one another via a tension spring, whereby the bearing plates execute, upon a vertical motion of the seam folder towards the guide part, a horizontal spreading motion in opposition to a biasing force exerted by the tension spring.

A fabric seam threading device pursuant to the particular features of the present invention is rapidly adaptable to fabrics of different thicknesses and also ensures rapid and secure threading of a fabric piece to be pressed.

DETAILED DESCRIPTION

Figures 1, 2A, 2B:
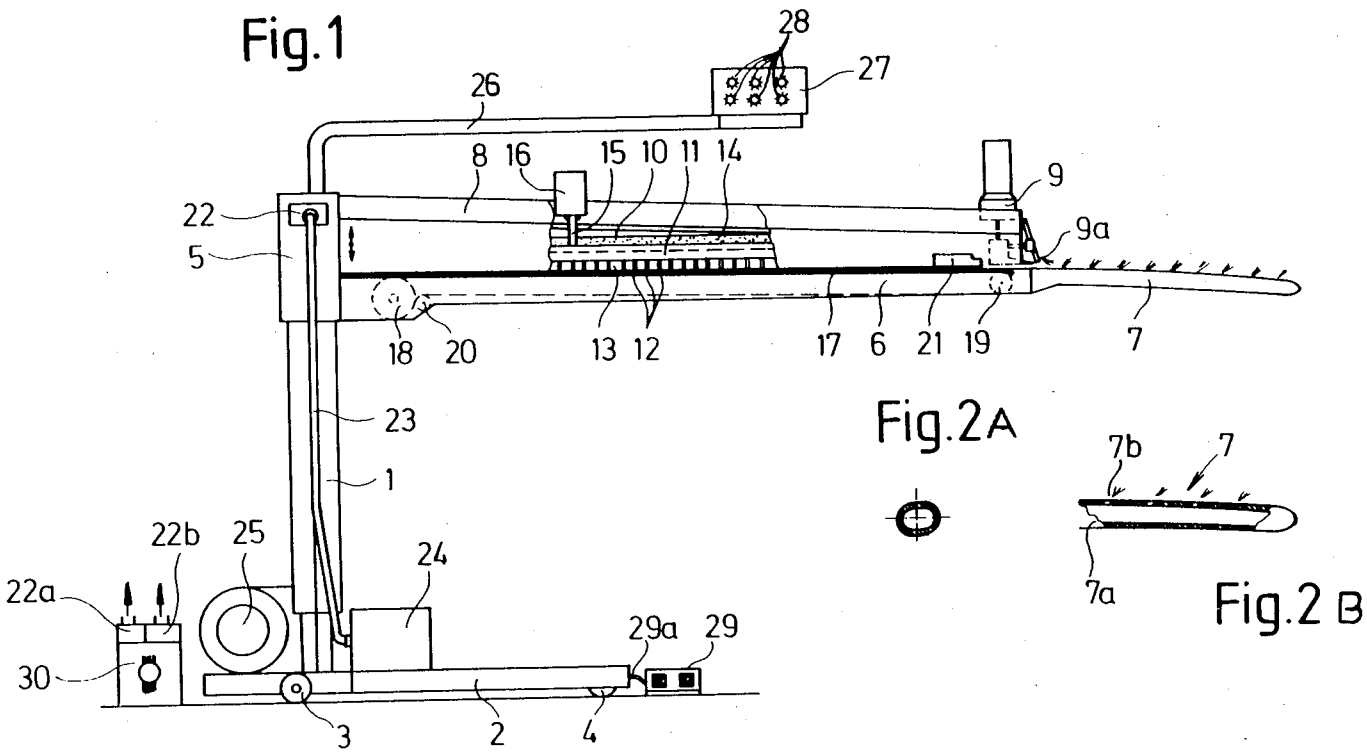
FIG. 1 is a side elevational view of a steam pressing station in accordance with the present invention.
FIG. 2A is a transverse cross sectional view of a fabric receiving member, taken along line IIA—IIA in FIG. 1.
FIG. 2B is a partial longitudinal cross sectional view taken along line IIB—IIB in FIG. 2A.

A steam pressing station shown in FIG. 1 comprises a support stand 1 having a base 2*a* and an upright post 2*b*. Rollers 3 are rotatably mounted to a base 2*a* for enabling at least a limited rolling motion of stand 1 along a floor surface. Stand 1 includes a stand head 5 at an upper end, a lower pressing member or sleeper 6 and an upper pressing member or sleeper 8 being fastened to stand head 5. A sleeper extension or fabric receiving member 7 is attached to a free end of lower pressing member 6 and is curved slightly downwardly. Upper pressing member 8 carries at a free end a fabric seam threading device 9 which functions to separate, during an inward motion of a fabric piece to be pressed, two fabric edge strips extending from a seam of the fabric piece. An air nozzle 9*a* is attached to a free end of upper pressing member 8, the air nozzle serving to direct a stream of air downwardly and forwardly (to the right in FIG. 1).

Upper pressing member 8 is adjustably mounted to stand head 5, as indicated in FIG. 1 by a double-headed arrow, whereby the vertical position of upper pressing member 8 may be varied. Upper pressing member 8 is open towards its lower side and includes a form pressing body 10 enclosing a steam chamber 11 and provided with an electrical heating element (not shown) for heating the steam chamber. Steam chamber 11 is defined in part by a pressing plate 13 which forms a lower wall of form pressing body 10. Pressing plate 13 has a plurality of steam openings or holes 13 which vent steam from steam chamber 11 to a fabric piece located in the gap between lower pressing member 6 and upper pressing member 8.

Form pressing body 10 includes, on a side facing upper pressing member 8, a heat insulation layer 14 and is attached to upper pressing member 8 for motion in a vertical direction, i.e., in a direction perpendicular to pressing plate 13. More particularly, form pressing body 10 is attached to a plunger or rod 15 of a pneumatic cylinder 16 in turn fastened to upper pressing member 8.

Lower pressing member 6 takes the form of a pan defining a suction chamber, lower pressing member 6 being equipped with a conveyor belt 17 which is controllably rotated in either of two opposite directions via a drive roller 18. Conveyor belt 17 also extends over a freely rotatable roller 19 and is pressed to drive roller 18 via a pressure roller 20 disposed in a lower extension of lower pressing member 6. Conveyor belt 17 is provided with a layer of silicon rubber which forms a pressing surface of lower pressing member 6.

Steam chamber 11 is connected via tubing 23 to a steam generator 24 preferably, but not necessarily, mounted to stand 1, particularly on base 2*a*. A magnetically operated valve 22 is disposed in tubing 23 for controlling steam delivery to steam chamber 11.

A blower 25 is also mounted on stand base 2*a*, the blower being connected via a conduit (not illustrated) to the suction chamber or pan of lower pressing member 6. Furthermore, a compressed air generator 30 is provided for supplying pressurized air to fabric receiving member 7 and to fabric seam threading device 9 via respective magnetically operated valves 22*a* and 22*b*.

As depicted in FIG. 1, a support rod 26 is pivotably mounted to stand head 5 at an upper end thereof and carries a control unit 27. Control unit 27 has an array of operating buttons 28 for setting the cycle times for a steam pressing process. Control unit 27 contains electrical circuitry for controlling the operation of blower 25, magnetic valves 22, 22*a* and 22*b*, lifting cylinder 16, fabric seam threading device 9, fabric edge holding device 21 and conveyor belt 17.

For initiating and interrupting a steam pressing cycle, a foot-actuated operating cycle switch 29 is provided on the floor next to stand base 2*a*. Switch 29 is operatively connected to control unit 27 via a cable 29*a* extending through stand post 2*b* and support rod 26.

The steam pressing station illustrated in FIG. 1 includes only a combination of a lower pressing member 6 and an upper pressing member 8 on stand 1. It is to be understood, however, that an optimal work station may require the provision of two such pressing member combinations on a single stand 1. The pairs of pressing members are positioned to enable a single operator to use both pressing member pairs in alternation. At such a work station, steam generator 24, blower 25 and compressed air generator 30 can be used for both pressing member pairs.

As shown in FIGS. 2*a* and 2*b*, fabric receiving member 7 advantageously takes the form of a tube defining an elongate pressure chamber 7*a* which terminates with a bow-shaped free end. In order to minimize the sliding friction existing between fabric receiving member 7 and a fabric piece during a withdrawal or removal of the fabric piece upon the completion of a pressing operation, pressure chamber 7*a* is connected to compressed air generator 30. Fabric receiving member or tube 7 is provided in an upper surface with an array of holes or vents 7*b* which are inclined upwardly towards the free end of fabric receiving member 7. During the withdrawal or ejection of a pressed fabric piece, air is blown through vents 7*b* against the fabric piece.

Figure 3:
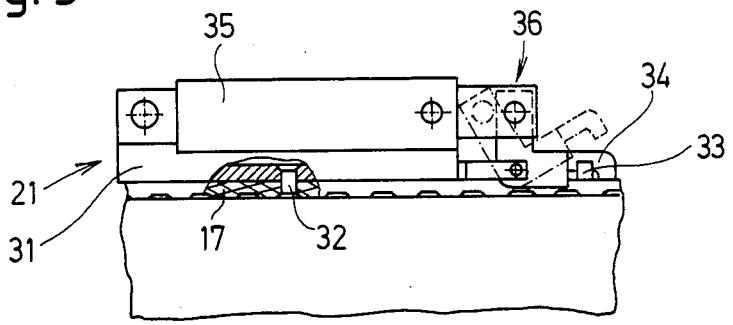
FIG. 3 is a side elevational view of a fabric edge holding device shown in FIG. 1.
Figure 4:
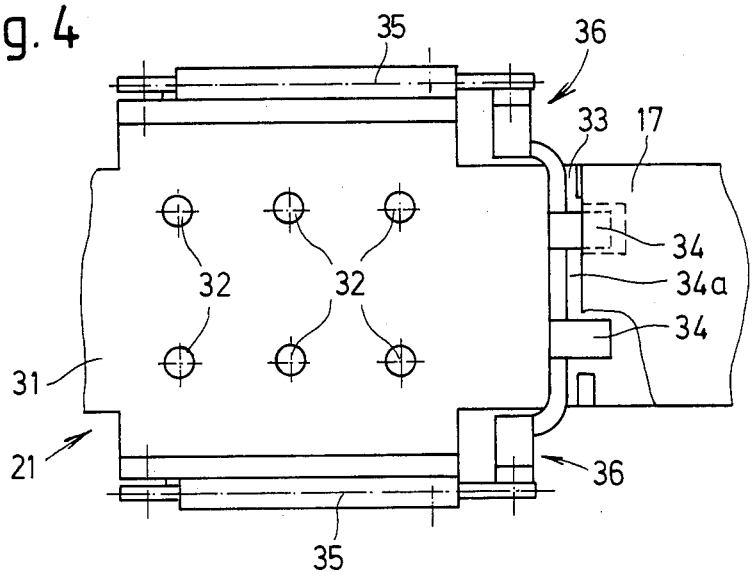
FIG. 4 is a top view of the fabric edge holding device of FIGS. 1 and 3.

As illustrated in FIGS. 3 and 4, a fabric edge holding device 21 is attached to conveyor belt 17 for clamping a leading edge of a fabric piece to the conveyor belt particularly during movement thereof drawing the fabric piece into the gap between lower pressing member 6 and upper pressing member 8. As depicted in FIG. 1, in a waiting position, fabric edge holding device 21 is disposed directly behind fabric seam threading device 9.

Fabric edge holding device 21 includes a base plate 31 (FIGS. 3 and 4) firmly secured to conveyor belt 17 by a plurality of rivets 32. Base plate 31 protrudes outwardly from both sides of conveyor belt 17 and is formed along the protruding sides with upwardly turned edge strips each carrying a respective drive cylinder 35 with a respective plunger 35*a* reciprocatable in a direction parallel to the direction of motion of conveyor belt 17.

Fabric edge holding device 21 also includes on a forward side (facing to the right in FIG. 1) an elongate fabric stop 33 extending perpendicularly to the direction of motion of conveyor belt 17. Two clamping fingers 34 reach over and beyond fabric stop 33, in a clamping configuration of the fabric edge holding device 21, to clamp a leading edge of a fabric piece to conveyor belt 17. Clamping fingers 34 are attached to a stay 34*a* spanning conveyor belt 17, stay 34*a* being connected to a pair of poles or bracket members 36 in turn connected to plungers 35*a* of drive cylinders 35. As depicted in FIG. 3 (compare dot-dash outline with solid outline of clamping fingers 34), a linear motion of plungers 35*a* is converted into a rotary motion of clamping fingers 34 about stay 34*a*, thereby effectuating a clamping of a leading edge of a fabric piece upon insertion thereof past fabric seam threading device 9 or a release of the leading fabric edge upon completion of a seam pressing operation.

Fabric stop 33 is preferably an integral component of base plate 31, so that no special manner of attachment need be considered.

Figure 5:
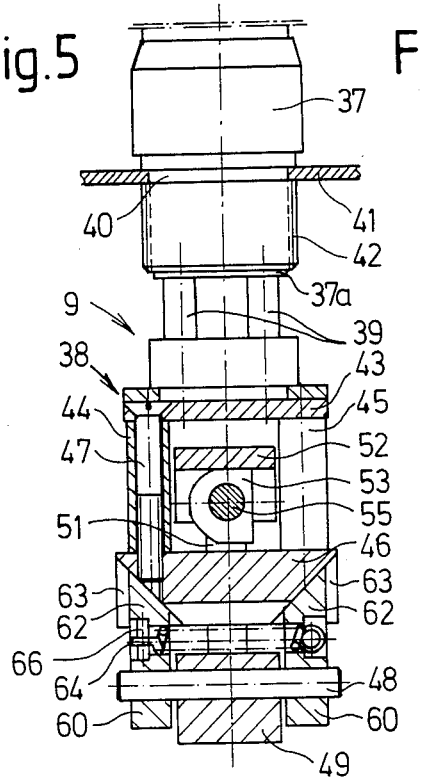
FIG. 5 is a partially cross sectional front elevational view of a fabric seam threading device illustrated in FIG. 1.
Figure 6:
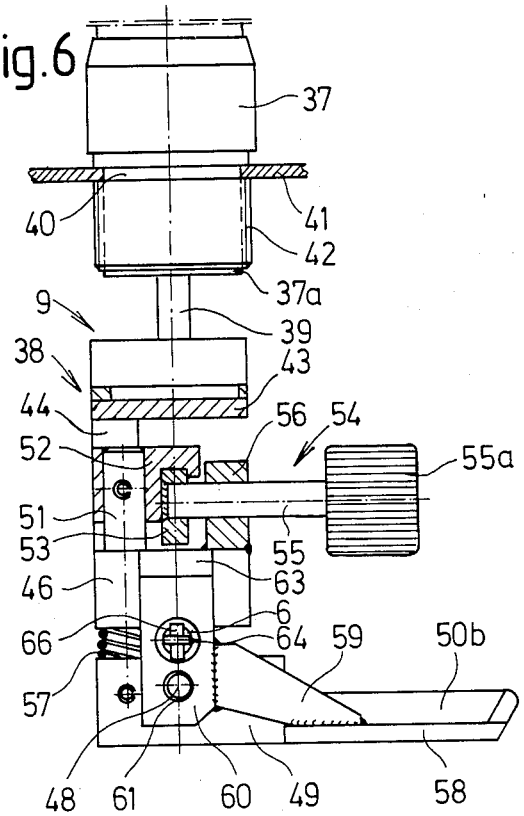
FIG. 6 is a partially cross sectional side elevational view of the fabric seam threading device illustrated in FIGS. 1 and 5.
Figure 7:
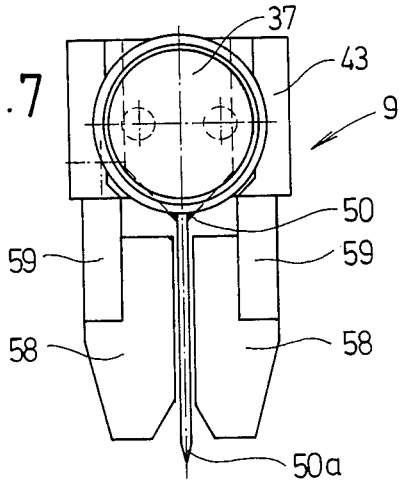
FIG. 7 is a top view of the fabric seam threading device illustrated in FIGS. 1, 5 and 6.

As illustrated in FIGS. 5, 6 and 7, fabric seam threading device 9 comprises a lifting cylinder 37 having a pair of plunger rods 39 attached to a guide body 3. At its lower end, lifting cylinder 37 is provided with a ring flange 37*a* which engages an opening 40 formed in a side wall 41 of upper pressing member 8 and which is bolted against the wall by means of a ring nut 42.

Guide body 38 has a head plate 43 connected to a foot plate 46 over two parallel spaced bushings 44 and 45. The connection of the head plate to the foot plate is accomplished by bolts 47 extending through bushings 44 and 45 (see FIG. 5).

Disposed below guide body 38 is a block-shaped seam folder 49 provided with a transverse pin 48 and fastened to the lower end of a guide pin 51 in turn slidably mounted to guide body 38. Guide pin 51 traverses a bore (not illustrated) in foot plate 46 and is connected at an upper end above foot plate 46 to a lifting head 52. Lifting head 52 engages an eccentric 53 forming a portion of a setting device 54. Eccentric 53 is fastened to an end of a horizontally extending shaft 55 which is pivotably mounted to a bearing 56 and which is provided at end end opposite eccentric 53 with a setting knob 55*a*. Upon a rotation of a setting knob 55*a* and consequently of eccentric 53, the position of seam folder 49 with respect to guide body 38 is adjusted in opposition to a biasing force exerted by a compression spring 57 coiled aroung guide pin 51 between foot plate 46 and seam folder 49. The adjustment of the vertical position of seam folder 49 may be effectuated in a continuous or a step-wise fashion.

Seam folder 49 is provided on a forward facing side (to the right in FIG. 1) with a keel 50 which in turn is provided with a seam separator sword 50*a*. Seam separator sword 50*a* is flanked on opposite sides by a pair of skid-like fabric seam guides 58 each mounted via a connecting piece or bracket 59 to a vertically extending bearing plate 60. Bearing plates 60 are each provided at a lower end with a bore 61 traversed by pin 48, whereby bearing plates 60 are mounted to seam folder 49 for motion in a horizontal or lateral direction with respect thereto. The upper end of each bearing plate 60 is beveled to form a wedge-shaped head 62 having an oblique or inclined face engaging a correspondingly inclined surface of foot plate 46 and facing the inclined face of the other bearing plate. Bearing plates 60 are partially disposed in respective splines or slots in foot plate 46 and are connected to one another via a tension spring 64. In opposition to a biasing force exerted by tension spring 64 and owing to the camming of the inclined faces of the bearing plates against the corresponding surfaces of foot plate 46, bearing plates 60 move apart during an upward movement of seam spreader 49 arising from a rotation of knob 55*a*. Inasmuch as bearing plates 60 are substantially fixed with respect to seam folder 49 in a vertical direction, the bearing plates and concomitantly seam guides 58 move upwardly as well as outwardly from one another during an upward motion of seam folder 49.

Preferably, the oblique faces of bearing plates 60 are inclined at a 45 degree angle. Accordingly, it is ensured that a predetermined change in the distance between seam folder 49 and guide body 38 always results in the same change in distance between each seam guide 58 and seam separator sword 50*a*. Setting device 54 thus permits a rapid adaptation of fabric seam threading device 9 to different fabric thicknesses.

Tension spring 64 has a pair of opposite ends projecting through respective bores 65 in bearing plates 60, the spring ends being held to the outer surface of the bearing plates via respective split pins 66.

As seen in FIG. 7, the tip of fabric seam separator sword 50*a* projects beyond the ends of seam guides 58 and has, as shown in FIG. 6, a frontal edge 50*b* inclined downwardly and rearwardly. Moreover, a skid-like sea guides 58 have tapered wedge-shaped front ends. The configurations of the seam separator sword and the laterally disposed seam guides, together with the entire structure of the fabric seam threading device, invariably provides for an easy and rapid separation of fabric edge strips at a seam being pressed at a steam pressing station pursuant to the invention.

In using a steam pressing station in accordance with the invention, a fabric piece is manually inserted over fabric receiving member 7 until a leading edge of the fabric piece abuts against fabric stop 33. Prior to the insertion operation, lifting cylinder 16 is operated to position pressing plate 13 at a predetermined distance from the upper surface of conveyor belt 17. During the insertion of the fabric piece, fabric seam threading device 9 separates fabric edge strips from one another, the fabric seam threading device having been set beforehand (knob 55*a*) to adjust the height of seam folder 49 and the separation of seam guides 59 to match the particular characteristics of the fabric material and the seam. Upon the initial, manual insertion of the fabric piece, drive cylinders 35 are actuated to rotate clamping fingers 34 into engagement with the leading fabric edge at fabric stop 33. Conveyor belt 17 is then revolved so that the fabric piece is drawn into the gap between lower pressing member 6 and upper pressing member 8. During the automatic drawing in of the fabric piece, fabric seam threading device 9 continues to separate the fabric edge strips at the seam from one another.

Preferably, during the drawing in of a fabric piece through the gap between the lower pressing member and the upper pressing member, the pressing plate 13 is spaced from the upper surface of the conveyor belt by a distance of approximately 5 mm. This distance ensures that a fabric seam folded in passing through the fabric seam threading device does not revert to its prior form.

Upon the completion of the intake stroke by conveyor belt 17, form pressing body 10 is lowered onto the fabric material and the steam pressing process is executed. The form pressing body is then raised so that the pressing plate 13 is spaced from the pressing surface of conveyor belt 17 by another predetermined distance, prefeably approximately 13 to 15 mm. This spacing is chosen to facilitate the withdrawal or ejection of the pressed fabric material.

Simultaneously with, or possibly previously to, the raising of form pressing body 10, guide body 38 (FIGS. 5–7) is raised by cylinder 37 to a level wherein the fabric seam threading device cannot hinder the ejection of the pressed fabric material. As discussed hereinabove, the ejection of the pressed material is facilitated by the directing of air through vents 7*b* in fabric receiving member 7.

A steam pressing station pursuant to the instant invention can be used wherever seams of sewn fabric parts require pressing prior to sale, exemplarily in ready-to-wear items of clothing. The steam pressing station ensures a predictably good result and quality clothing.

What is claimed is:

1. A steam pressing station for pressing fabric seams, comprising:

a support stand;

a blower;

a lower pressing member fastened to said stand, said lower pressing member being formed with a suction chamber, said suction chamber being connected to said blower, said lower pressing member including a conveyor belt forming a pressing surface of said lower pressing member;

motor means operatively connected to said conveyor belt for selectively revolving same in either of two opposite directions;

an upper pressing member fastened to said stand above said lower pressing member, said upper pressing member including a form pressing body movable in a direction substantially perpendicular with respect to said pressing surface of said lower pressing member, said form pressing body being provided with a heatable seam chamber connectable to a steam generator, said form pressing body being further provided with a pressing plate defining a lower side of said steam chamber and having a plurality of steam openings;

fabric seam threading means attached to said upper pressing member at a free end thereof for separating fabric edge strips extending from a seam to be pressed;

a fabric receiving member fastened to said lower pressing member at a free end thereof;

fabric edge holding means for clamping against said conveyor belt a leading edge of a fabric piece to be pressed upon a drawing of said leading edge past said fabric seam threading means and for continuing to hold said leading edge to said conveyor belt during a drawing of said fabric piece between said lower pressing member and said upper pressing member and past said fabric seam threading means, said fabric edge holding means being movably mounted to said stand to follow motions of said conveyor belt at said pressing surface.

2. The steam pressing station set forth in claim 1 wherein said fabric edge holding means comprises a structural element fastened to said conveyor belt, said fabric edge holding means being provided with means for varying a force with which fabric is held to said conveyor belt.

3. The steam pressing station set forth in claim 2 wherein said structural element takes the form of a base plate provided on a front side facing said fabric receiving member with an elongate fabric stop extending transversely to a direction of motion of said conveyor belt at said pressing surface.

4. The steam pressing station set forth in claim 3 wherein said base plate is provided along opposed sides with a pair of upturned edge strips projecting away from a plane of said conveyor belt at said pressing surface, said fabric edge holding means including a fabric clamping device pivotably mounted to said upturned edge strips for rotational motion about a horizontal axis extending perpendicularly to said direction of motion of said conveyor belt, said fabric edge holding means further including a reciprocatable drive device mounted to one of said upturned edge strips and extending parallel to said direction of motion, said drive device being connected to said fabric clamping device for pivoting same about said horizontal axis.

5. The steam pressing station set forth in claim 4 wherein said fabric clamping device comprises a plurality of arcuate clamping fingers engageable with said leading edge at said fabric stop.

6. The steam pressing station set forth in claim 1 wherein said fabric receiving member has a downwardly curved free end.

7. The steam pressing station set forth in claim 1 wherein said fabric receiving member is tubular and is connectable to a pressure source via a controllable valve, said fabric receiving member being provided at an upper surface with a plurality of air vents disposed in a linear array from one end of said fabric receiving member to an opposite end thereof, said air vents being inclined with respect to said upper surface upwardly towards a free end of said fabric receiving member.

8. The steam pressing station set forth in claim 1, further comprising lifting means operatively connected to said form pressing body for holding said form pressing body so that said pressing plate is disposed at a first distance from said pressing surface during a drawing in of said fabric piece and for holding said form pressing body so that said pressing plate is disposed at a second distance from said pressing surface during an ejection motion of said conveyor belt upon completion of a seam pressing process, said first distance being smaller than said second distance.

9. The steam pressing station set forth in claim 8 wherein said second distance is approximately three times said first distance, said first distance being selected to ensure spreading of said fabric edge strips by said fabric seam threading means during a drawing in a said fabric piece.

10. The steam pressing station set forth in claim 1 wherein said fabric seam threading means includes a guide body mounted to said upper pressing member via a reciprocatable drive device, said fabric seam threading means further including a block-shaped seam folder adjustably mounted to said guide body for varying a vertical position of said seam folder relative to said guide body, said fabric seam threading means further including a seam separator element attached to said seam folder and a pair of skid-shaped fabric seam guides attached to said seam folder on opposite sides of said seam separator element, said seam separator element having a top projecting beyond free ends of said seam guides, said seam guides being slidably attached to said seam folder so that a distance between said seam guides varies as a function of a vertical position of said seam guides relative to said guide body.

11. The steam pressing station set forth in claim 10 wherein said guide part includes a head plate and a foot plate, said head plate being firmly connected to a reciprocatable element of said drive device and fastened to said foot plate via a plurality of bushings extending parallel to one another, said seam folder being slidably mounted to said guide part via a vertical extending guide pin, said fabric seam threading means further including a compression spring disposed between said foot plate and said seam folder for biasing said seam folder away from said guide part, said fabric seam threading means also including a manually operable eccentric and a lift head element fastened to said guide pin at an upper end thereof in engagement with said eccentric for enabling a controlled lifting of said seam folder relative to said guide part and in opposition to a biasing force exerted by said compression spring.

12. The steam pressing station set forth in claim 11 wherein said seam guides are fastened via respective connecting pieces to respective bearing plates each provided at a lower end with a bore traversed by a pin connected to said seam folder and formed at an upper end with a beveled end surface engaging a respective inclined face on said foot plate, said bearing plates being connected to one another via a tension spring, whereby said bearing plates execute, upon a vertical motion of said seam folder towards said guide part, a horizontal spreading motion in opposition to a biasing force exerted by said tension spring.

13. The steam pressing station set forth in claim 12 wherein said seam guides execute horizontal motions of substantially the same magnitude during a stroke of said seam folder.

14. The steam pressing station set forth in claim 1, further comprising air ejection means including an air nozzle attached to said fabric seam threading means for directing a stream of air in an ejection direction of said fabric piece and obliquely towards said fabric receiving member.

* * * * *